US011549497B2

(12) United States Patent
Takei et al.

(10) Patent No.: US 11,549,497 B2
(45) Date of Patent: Jan. 10, 2023

(54) HYDRAULIC ROTATING MACHINE

(71) Applicant: KYB Corporation, Tokyo (JP)

(72) Inventors: Gen Takei, Kanagawa (JP); Tetsuya Iwanaji, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 17/276,353

(22) PCT Filed: Sep. 24, 2019

(86) PCT No.: PCT/JP2019/037383

§ 371 (c)(1),
(2) Date: Mar. 15, 2021

(87) PCT Pub. No.: WO2020/152909

PCT Pub. Date: Jul. 30, 2020

(65) Prior Publication Data

US 2022/0049685 A1 Feb. 17, 2022

(30) Foreign Application Priority Data

Jan. 24, 2019 (JP) ..... JP2019-010394

(51) Int. Cl.

| | |
|---|---|
| ***F04B 1/324*** | (2020.01) |
| ***F04B 1/2078*** | (2020.01) |
| *F03C 1/40* | (2006.01) |
| *F04B 1/2014* | (2020.01) |

(52) U.S. Cl.

CPC ..... *F04B 1/2078* (2013.01); *F03C 1/0686* (2013.01); *F04B 1/2014* (2013.01); *F04B 1/324* (2013.01)

(58) Field of Classification Search

CPC ..... F04B 1/324; F04B 1/295; F04B 1/2078; F04B 27/22; F04B 49/125; F04B 1/20; F04B 1/2014; F04B 39/12; F04B 53/14; F04B 53/16; F01B 3/106; F01B 3/102; F01B 3/0032; F01B 3/0044; F01B 3/02;

(Continued)

(56) References Cited

U.S. PATENT DOCUMENTS 3,209,538 A * 10/1965 Kuze ..... B60K 17/10 60/444
5,253,576 A * 10/1993 Bethke ..... F04B 1/2085 92/12.2

(Continued)

FOREIGN PATENT DOCUMENTS

CN 2164469 Y 5/1994
JP H025762 A 1/1990

(Continued)

*Primary Examiner* — Thomas Fink
(74) *Attorney, Agent, or Firm* — Rabin & Berdo, P.C.

(57) ABSTRACT

A hydraulic rotating machine includes a case, a cylinder block housed in the case and having a plurality of cylinders, a piston reciprocatively inserted into the cylinder; a swash plate configured to reciprocate the piston as the cylinder block rotates, a tilt control piston configured to biase the swash plate and control a tilt angle of the swash plate, and a stopper mounted to the case, the stopper being configured to define a minimum tilt angle of the swash plate. The stopper has a sliding surface for slidably supporting the tilt control piston.

2 Claims, 3 Drawing Sheets

(58) Field of Classification Search
CPC .... F03C 1/0636; F03C 1/0686; F03C 1/0663; F03C 1/0644
USPC ..... 92/57; 417/222.1
See application file for complete search history.

(56) References Cited

U.S. PATENT DOCUMENTS

| | | | | |
|---|---|---|---|---|
| 5,295,796 | A * | 3/1994 | Goto | F04B 1/324 417/222.1 |
| 2013/0298546 | A1* | 11/2013 | Oh | F16H 61/423 60/487 |
| 2014/0186196 | A1* | 7/2014 | Mizoguchi | F04B 1/2085 417/269 |
| 2019/0032645 | A1* | 1/2019 | Matsuo | F04B 1/2064 |
| 2020/0340360 | A1* | 10/2020 | Iwanaji | F04B 1/324 |

FOREIGN PATENT DOCUMENTS

| | | | |
|---|---|---|---|
| JP | H0754758 | A | 2/1995 |
| JP | H08-200209 | A | 8/1996 |
| JP | 2012255375 | A * | 12/2012 |
| WO | 2013005703 | A1 | 1/2013 |

* cited by examiner

HYDRAULIC ROTATING MACHINE

TECHNICAL FIELD

The present invention relates to a hydraulics rotating machine.

BACKGROUND ART

There is a hydraulic rotating machine which includes a swash plate which is provided in a casing so as to be tiltable, and a tilt control piston which controls the tilt angle of the swash plate (see JPH8-200209A). In the hydraulic rotating machine described in JPH8-200209A, a cylinder hole is formed in the casing, the tilt control piston is slidably inserted into the cylinder hole.

SUMMARY OF INVENTION

In the hydraulic rotating machine described in JPH8-200209A, since the tilt control piston slides in the cylinder hole, the inner peripheral surface of the cylinder hole is worn, thereby there is a possibility that the performance of a pump is deteriorated. To suppress wear of the inner peripheral surface of the cylinder hole, it is effective to perform a surface treatment such as heat treatment as a method of improving the hardness of the inner peripheral surface of the cylinder hole. However, it is not easy to perform the surface treatment such as heat treatment to the inner peripheral surface of the cylinder hole formed in the casing.

The present invention aims to easily improve a wear resistance of a sliding surface that a tilt control piston slides.

According to one aspect of the present invention, a hydraulic rotating machine includes: a case; a cylinder block housed in the case and having a plurality of cylinders, a piston reciprocatively inserted into the cylinder; a swash plate configured to reciprocate the piston as the cylinder block rotates, a tilt control piston configured to biase the swash plate and control a tilt angle of the swash plate; and a stopper mounted to the case, the stopper being configured to define a minimum tilt angle of the swash plate. The stopper has a sliding surface for slidably supporting the tilt control piston.

DESCRIPTION OF EMBODIMENT

Figure 1:
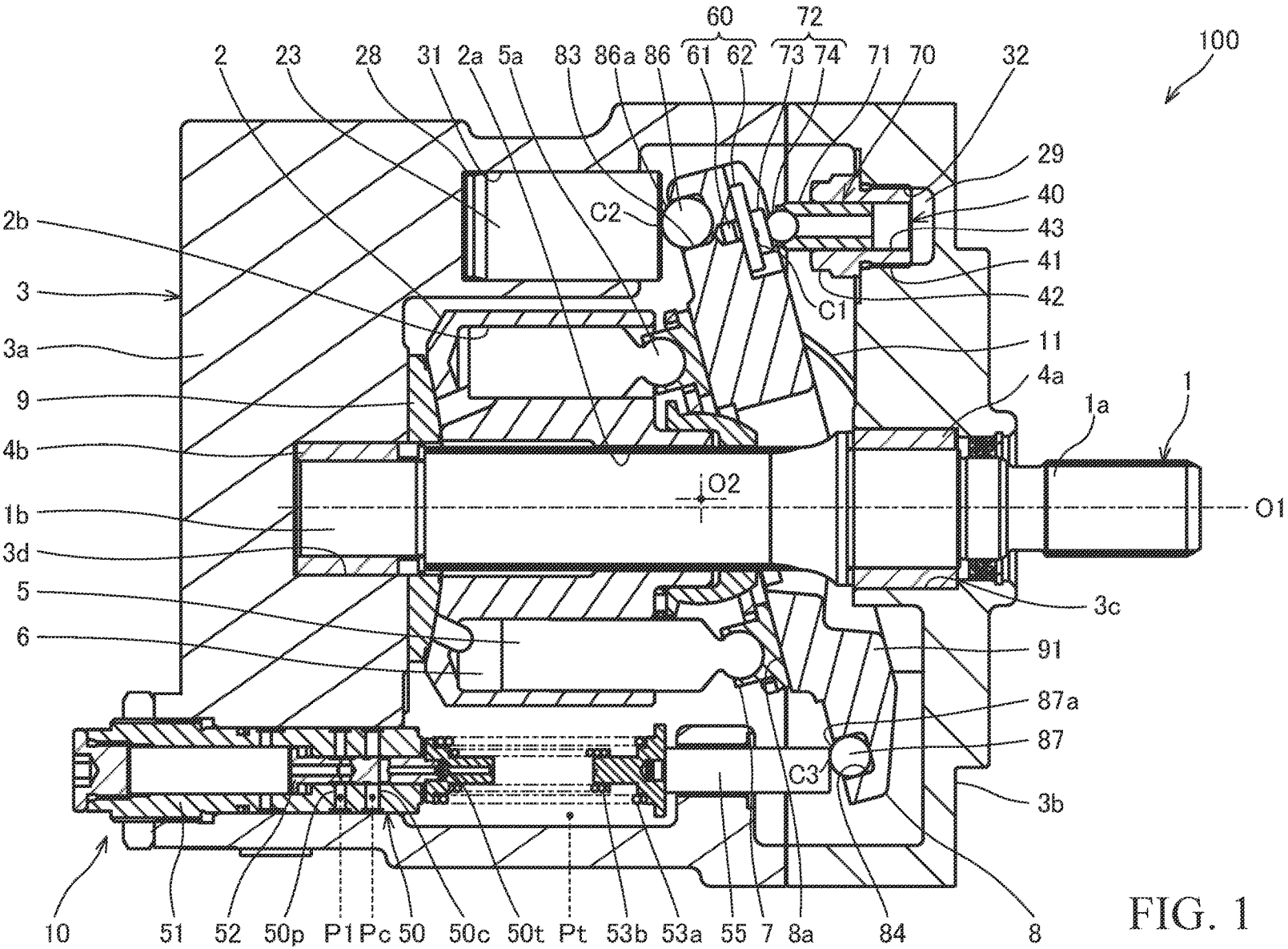
FIG. 1 is a cross-sectional view of a hydraulic rotating machine according to an embodiment of the present invention, showing a state in which a tilt angle is maximum.
Figure 2:
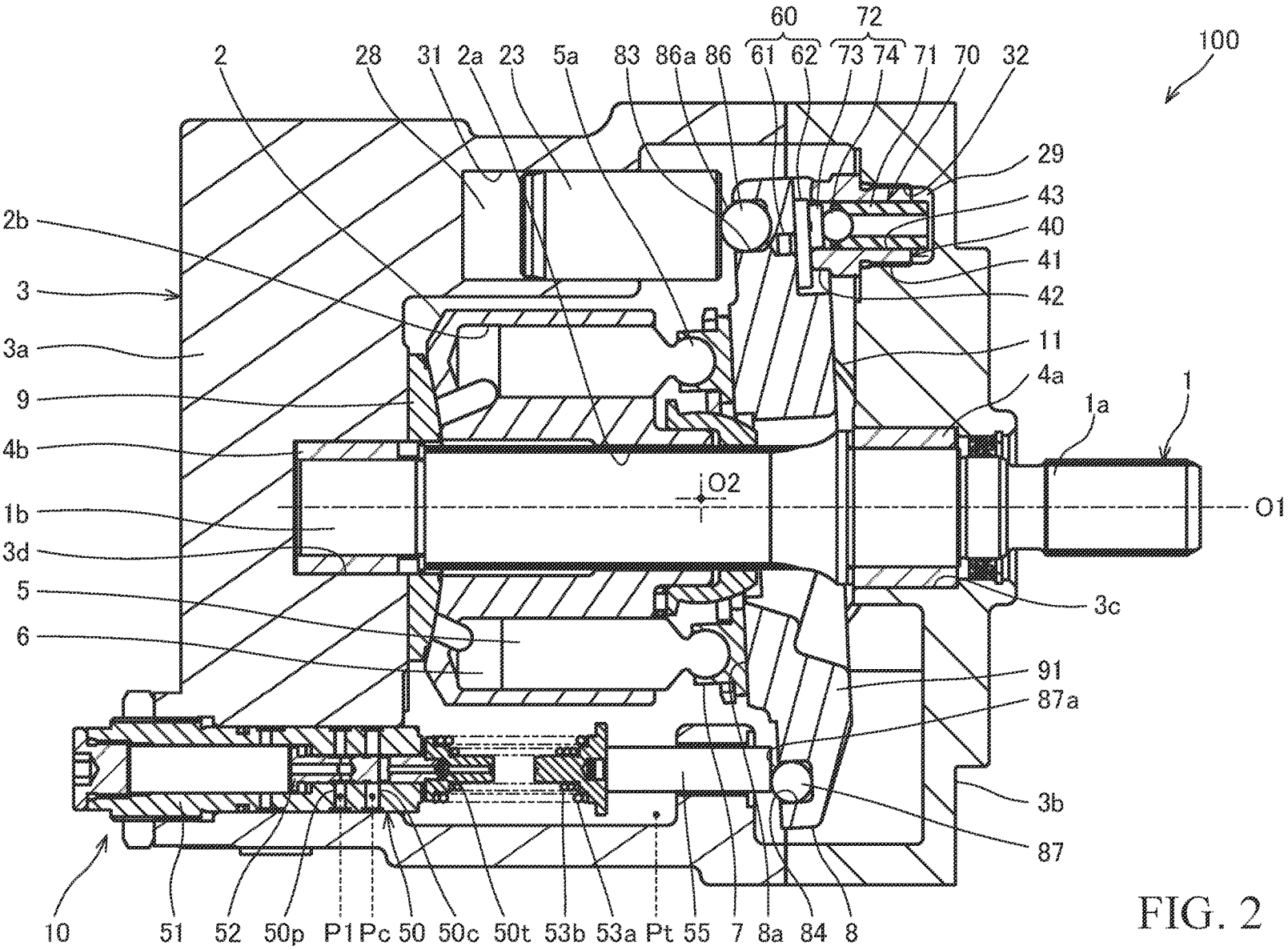
FIG. 2 is a cross-sectional view of the hydraulic rotating machine according to the embodiment of the present invention, showing a state in which the tilt angle is minimum.
Figure 3A:
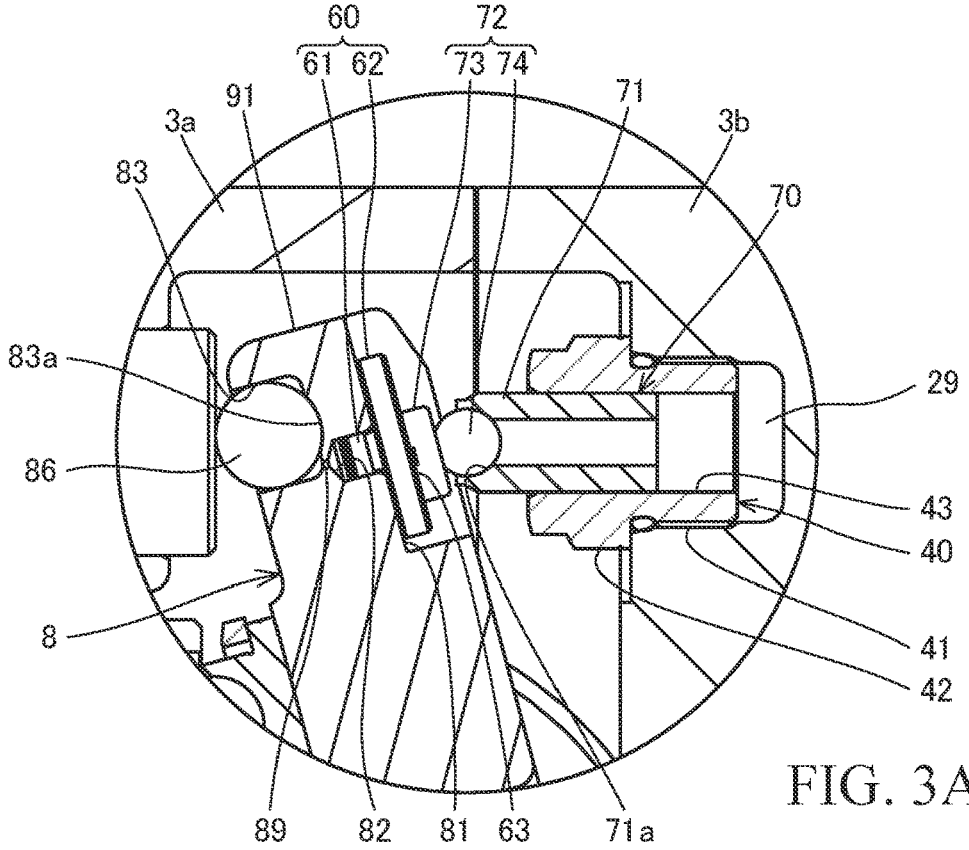
FIG. 3A is a partial enlarged view of FIG. 1.
Figure 3B:
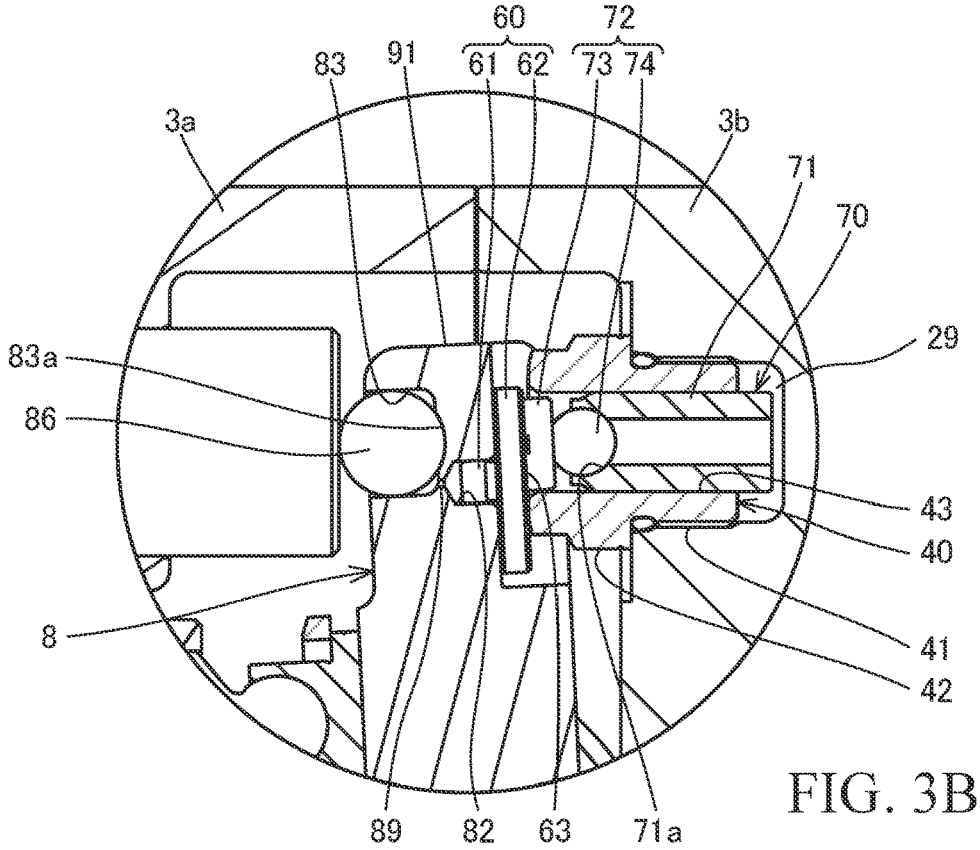
FIG. 3B is a partial enlarged view of FIG. 2.

A hydraulic rotating machine according to an embodiment of the present invention will be described with reference to the drawings. FIGS. 1 and 2 are a cross-sectional view of the hydraulic rotating machine. FIG. 1 shows a state in which a tilt angle is maximum, FIG. 2 shows a state in which the tilt angle is minimum. FIG. 3A is a partial enlarged view of FIG. 1, and FIG. 3B is a partial enlarged view of FIG. 2.

The hydraulic rotating machine functions as a piston pump capable of discharging a hydraulic oil as a working fluid by rotating a shaft 1 and reciprocating a piston 5 by an power from the outside. The hydraulic rotating machine also functions as a piston motor capable of outputting a rotational driving force by reciprocating the piston 5 and rotating the shaft 1 by the fluid pressure of the hydraulic oil supplied from the outside. Incidentally, the hydraulic rotating machine may function only as the piston pump, or may function only as the piston motor.

In the present embodiment, a case where the hydraulic rotating machine is used as a swash plate type piston pump will be exemplified. Hereinafter, the hydraulic rotating machine is referred to as a "piston pump 100".

As shown in FIGS. 1 and 2, the piston pump 100 is used as a hydraulic supply source for supplying hydraulic oil to an actuator such as a hydraulic cylinder (not shown). The piston pump 100 includes a shaft 1 which is rotated by a power source such as an engine (not shown), a cylinder block 2 which is connected to the shaft 1 and rotates together with the shaft 1, and a case 3 which houses the cylinder block 2, as shown in FIG. 1. Hereinafter, a direction along a rotation center axis O1 of the cylinder block 2 (i.e. a central axis of the shaft 1) is referred to as an axial direction, a circumferential direction around the rotation center axis O1 of the cylinder block 2 is referred to as a circumferential direction.

The case 3 includes a bottomed cylindrical case body 3*a* whose one end opens, and a cover 3*b* that closes the open end of the case body 3*a*. An inside of the case 3 communicates with a tank (not shown) through a drain passage (not shown).

The cover 3*b* is provided with a through hole 3*c* through which the shaft 1 penetrates. One end 1*a* of the shaft 1 is rotatably supported by the through hole 3*c* of the cover 3*b* via a bearing 4*a*. A power source such as an engine (not shown) is connected to the end 1*a* of the shaft 1 protruding from the case 3 to the outside.

The bottom of the case body 3*a* is provided with a shaft housing portion 3*d* that houses the other end 1*b* of the shaft 1. The end 1*b* of the shaft 1 is rotatably supported by the shaft housing portion 3*d* of the case body 3*a* via a bearing 4*b*. Incidentally, the bottom of the case body 3*a* may be provided with the shaft housing portion 3*d* as a through hole through which the shaft 1 penetrates, and a rotary shaft of other hydraulic pump such as a gear pump (not shown) may be connected to the end 1*b* of the shaft 1 protruding from the case 3 to the outside.

The cylinder block 2 is provided with a through hole 2*a* through which the shaft 1 penetrates. The through hole 2*a* of the cylinder block 2 is splined to the shaft 1. Thus, the cylinder block 2 rotates with the rotation of the shaft 1.

The cylinder block 2 is provided with a plurality of cylinders 2*b* which open at one end of the cylinder block 2. The cylinders 2*b* are formed in parallel with the shaft 1. The plurality of cylinders 2*b* are formed with a predetermined interval in the circumferential direction of the cylinder block 2. A cylindrical piston 5 is reciprocatively inserted into the cylinder 2*b*, and a volume chamber 6 is formed by the cylinder 2*b* and the piston 5. The distal end of the piston 5 protrudes from a opening of the cylinder 2*b*. A spherical seat 5*a* is formed at the distal end of the piston 5, the spherical seat 5*a* is rotatably connected to a shoe 7 described later.

The piston pump 100 further includes a swash plate 8 that reciprocates the piston 5 as the cylinder block 2 rotates, a shoe 7 that is in sliding contact with a sliding contact surface 8*a* formed on the front surface (a surface on the left side shown in the drawing) of the swash plate 8, and a valve plate 9 that is provided between the cylinder block 2 and the bottom portion of the case body 3*a*.

The swash plate 8 is swingably supported by the case 3 via a tilt bearing 11. In the piston pump 100, a stroke of the piston 5 with respect to the cylinder 2*b* is changed by changing a tilt angle of the swash plate 8. Thus, the pump capacity (displacement volume) which is a discharge amount of the hydraulic oil per rotation of the piston pump 100 is changed. The pump capacity becomes a minimum value when the tilt angle of the swash plate 8 is a minimum value. The pump capacity increases as the tilt angle of the swash plate 8 increases and becomes a maximum value when the tilt angle of the swash plate 8 is a maximum value. The tilt angle of the swash plate 8 is controlled by a tilt control device 10 described later.

The valve plate 9 is a member which a base end surface of the cylinder block 2 is in sliding contact with. The valve plate 9 is fixed to the bottom of the case body 3*a*. Although not shown, a suction port and a discharge port are formed in the valve plate 9. The suction port connects a suction passage formed on the case body 3*a* and the volume chamber 6. The discharge port connects a discharge passage formed on the case body 3*a* and the volume chamber 6.

The tilt control device 10 includes a large-diameter piston 23 as a tilt control piston for controlling the tilt angle of the swash plate 8, and a pressure chamber 28 that the large-diameter piston 23 faces. The case body 3*a* is provided with a housing recess 31 in which the large-diameter piston 23 is reciprocally accommodated. The pressure chamber 28 is formed by the housing recess 31 and the large-diameter piston 23. The large-diameter piston 23 is disposed so as to face the front surface of the swash plate 8 (the surface on the left side shown in the drawing). The large-diameter piston 23 biases the swash plate 8 in a direction in which the tilt angle decreases by the pressure of the pressure chamber 28.

The tilt control device 10 further includes a stopper 40 that defines a minimum value (a minimum tilt angle) of the tilt angle of the swash plate 8, a small-diameter piston 70 as a tilt control piston that controls the tilt angle of the swash plate 8, and a pressure chamber 29 that the small-diameter piston 70 faces. A mounting hole 32 is formed in the cover 3*b*. The the stopper 40 is mounted to the mounting hole 32. The stopper 40 has a through hole. The inner peripheral surface of the through hole is a sliding surface 43 for slidably supporting the small-diameter piston 70. The pressure chamber 29 is formed by the mounting hole 32, the stopper 40, and the small-diameter piston 70. The small-diameter piston 70 is disposed so as to face the back surface of the swash plate 8 (a surface of the right side shown in the drawing). The small-diameter piston 70 biases the swash plate 8 in a direction in which the tilt angle increases by the pressure of the pressure chamber 29.

The large-diameter piston 23 and the small-diameter piston 70 are disposed to face each other across the swash plate 8. In the present embodiment, the large-diameter piston 23 and the small-diameter piston 70 are arranged so as to be concentric.

The pressure chamber 29 is connected to the discharge passage (not shown) of the piston pump 100. Therefore, the discharge pressure P1 (self-pressure) of the piston pump 100 is always guided to the pressure chamber 29 through the discharge passage (not shown).

The tilt control device 10 further includes a control pressure adjusting device 50 for adjusting the pressure (Hereinafter, referred to control pressure Pc) of the pressure chamber 28. The control pressure adjusting device 50 adjusts the control pressure Pc in accordance with the discharge pressure P1 of the piston pump 100 to control an output of the piston pump 100.

The control pressure adjusting device 50 includes a control pressure adjusting spool 52 for adjusting the control pressure Pc, a sleeve 51 for axially movably accommodating the control pressure adjusting spool 52, a cylindrical feedback pin 55 that abuts the swash plate 8, and springs 53*a* and 53*b* as biasing members for biasing the feedback pin 55 toward the swash plate 8 and for biasing the control pressure adjusting spool 52 in a direction for switching the control pressure adjusting spool 52 to a tank communication position described later.

The tilt angle of the swash plate 8 is adjusted by a balance of a moment around a swing center axis O2. The direction of the moment of the force transmitted from the feedback pin 55 to the swash plate 8 by the elastic force of the springs 53*a* and 53*b* is the same as a direction of the moment of the force transmitted from the small-diameter piston 70 to the swash plate 8 by the pressure of the pressure chamber 29, and is opposite to a direction of the moment of the force transmitted from the large-diameter piston 23 to the swash plate 8 by the pressure of the pressure chamber 28.

The control pressure adjusting device 50 has a pump port 50*p* communicating with the discharge passage (not shown) of the piston pump 100, a tank port 50*t* communicating with a tank (not shown), and a control pressure port 50*c* communicating with the pressure chamber 28.

The control pressure adjusting spool 52 has a pump communication position and a tank communication position. In the pump communication position, the pump port 50*p* and the control pressure port 50*c* communicate with each other and a communication between the tank port 50*t* and the control pressure port 50*c* is blocked. In the tank communication position, the tank port 50*t* and the control pressure port 50*c* communicate with each other and a communication between the pump port 50*p* and the control pressure port 50*c* is blocked.

When the control pressure adjusting spool 52 is switched to the pump communication position, the hydraulic oil discharged from the piston pump 100 is guided to the pressure chamber 28, and the control pressure Pc increases. When the control pressure Pc becomes higher than the predetermined pressure, the swash plate 8 tilts in a direction in which the tilt angle of the swash plate 8 decreases, and the pump capacity decreases.

When the control pressure adjusting spool 52 is switched to the tank communication position, the hydraulic oil of the pressure chamber 28 is discharged to the tank (not shown), and the control pressure Pc decreases. When the control pressure Pc becomes lower than the predetermined pressure, the swash plate 8 tilts in a direction in which the tilt angle of the swash plate 8 increases, and the pump capacity increases.

The control pressure adjusting device 50 may include a port which the discharge pressure (external pump pressure) of another pump driven by the engine (not shown) together with the piston pump 100, and/or the signal pressure (external signal pressure) from the outside is guided. In this case, the control characteristics of the swash plate 8 can be adjusted by the external pump pressure and/or the external signal pressure.

The piston pump 100 is controlled by the tilt control device 10 so that the pump capacity decreases when the discharge pressure P1 increases and the pump capacity increases when the discharge pressure P1 decreases. Hereinafter, as an example of the operation of the piston pump 100, the operation of the piston pump 100 when the discharge pressure P1 increases to the predetermined pressure will be described.

If the discharge pressure P1 of the piston pump 100 is less than a predetermined value, the pump capacity is maintained at a maximum state (see FIG. 1). When the discharge pressure P1 increases to a predetermined pressure equal to or higher than the predetermined value, the control pressure adjusting spool 52 moves to the right in the drawing and is switched to the pump communication position. When the control pressure adjusting spool 52 is switched to the pump communication position, the pressure in the pressure chamber 29 (the control pressure Pc) increases and the large-diameter piston 23 presses the swash plate 8, so that the tilt angle of the swash plate 8 decreases.

When the tilt angle of the swash plate 8 decreases as the control pressure Pc increases, the feedback pin 55 is pushed leftward in the drawing by the swash plate 8. When the feedback pin 55 is pushed to the leftward, the control pressure adjusting spool 52 is pushed back to the leftward by being biased by the feedback pin 55 via the springs 53*a* and 53*b* and switched to the tank communication position. When the control pressure adjusting spool 52 is switched to the tank communicating position, the pressure of the pressure chamber 28 decreases. When the control pressure Pc decreases, the tilt angle of the swash plate 8 increases because the swash plate 8 is pressed by the small-diameter piston 70.

When the tilt angle of the swash plate 8 increases as the control pressure Pc decreases, the control pressure adjusting spool 52 is switched to the pump communication position again, and the tilt angle of the swash plate 8 decreases. Thus, in the tilt control device 10, the increase and decrease of the tilt angle of the swash plate 8 is repeated. When the moment of the force transmitted from the small-diameter piston 70 and the feedback pin 55 to the swash plate 8 and the moment of the force transmitted from the large-diameter piston 23 to the swash plate 8 are balanced, the tilt of the swash plate 8 is stopped, and the tilt angle of the swash plate 8 becomes a tilt angle in accordance with the discharge pressure P1.

Thus, in the present embodiment, a horsepower control is performed in which the pump capacity is controlled in accordance with the discharge pressure P1 so that an output of the piston pump 100 is kept constant. In the horsepower control, when the discharge pressure P1 of the piston pump 100 increases, the tilt angle is controlled so that the pump capacity decreases. Thus, it is possible to prevent an overload of the engine (not shown) as the power source of the piston pump 100.

In general, in a piston pump, the members constituting the piston pump may wear due to sliding, and thereby, backlash between the members occur. The backlash between the members may cause deterioration of the pump performance, such as unstable discharge rate of the piston pump. Therefore, in order to maintain the pump performance over a long period, it is effective to suppress the wear of the member. As a method for suppressing the wear of the member, it is effective to perform surface treatment such as heat treatment on the member. However, depending on size and shape of the member, it may not be easy to perform the surface treatment. For example, since the case body 3*a* and the cover 3*b* constituting the case 3 are large and complicated shape compared to other components, it is particularly difficult to perform the surface treatment to the case body 3*a* and the cover 3*b*.

Therefore, in the present embodiment, the cover 3*b* does not directly slidably support the small-diameter piston 70 which is a sliding component, but a small component mounted to the cover 3*b* slidably supports the small-diameter piston 70. In addition, the stopper 40 which defines the minimum tilt angle of the swash plate 8 is adopted as the small component for slidably supporting the small-diameter piston 70. That is, the stopper 40 according to the present embodiment has both a function of defining the minimum tilt angle of the swash plate 8 and a function of slidably supporting the small-diameter piston 70. Thus, as compared with a case of providing individually parts having respective functions, it is possible to reduce the number of parts.

The swash plate 8 includes a swash plate body 91 formed by casting or the like, a piston receiving member 60 disposed between the swash plate body 91 and the small-diameter piston 70, a first support member 86 disposed between the swash plate body 91 and the large-diameter piston 23, and a second support member 87 disposed between the swash plate body 91 and the feedback pin 55.

The stopper 40 has a mounting portion 41 which is mounted to the mounting hole 32 of the cover 3*b*, and an abutting portion 42 which abuts the piston receiving member 60 which is attached to the swash plate 8. A male screw is formed on the outer periphery of the mounting portion 41. The male screw is screwed onto a female screw which is formed on the inner periphery of the mounting hole 32.

As shown in FIGS. 1 and 3A, a state in which the large-diameter piston 23 abuts against the bottom of the housing recess 31 and the protruding length of the small-diameter piston 70 protruding from the stopper 40 toward the swash plate 8 is maximized is a state in which the tilt angle of the swash plate 8 is maximized. From this state, the tilt angle of the swash plate 8 is decreased, and as shown in FIGS. 2 and 3B, when the piston receiving member 60 attached to the swash plate 8 abuts the distal end surface of the abutting portion 42 of the stopper 40, it is restricted that the tilt angle of the swash plate 8 is further decreased. A state in which the piston receiving member 60 attached to the swash plate 8 abuts the distal end surface of the abutting portion 42 and the small-diameter piston 70 is housed in the stopper 40 is a state in which the tilt angle of the swash plate 8 is minimized.

As shown in FIGS. 3A and 3B, the small-diameter piston 70 accommodated in the through hole of the stopper 40 has a cylindrical piston body 71 and a piston shoe 72 provided at the distal end of the piston body 71. The piston shoe 72 has a disc-shaped base 73 and a spherical seat 74 which is fixed to the base 73. Incidentally, the base 73 and the spherical seat 74 may be formed as a single component by integral molding.

A receiving portion 71*a* for receiving the spherical seat 74 of the piston shoe 72 is formed at the distal end of the piston body 71. The inner surface of the receiving portion 71*a* is formed in a spherical shape so as to be in sliding contact with the outer surface of the spherical seat 74. This allows the piston shoe 72 to be displaced in any direction relative to the piston body 71.

The piston receiving member 60 is attached to a step portion 81 formed on the back surface of the swash plate 8. A back-side recess 82 as a recess portion is formed on the step portion 81. The piston receiving member 60 has a cylindrical press-fit portion 61 which is press-fitted and fixed to the back-side recess 82, and a disc-shaped receiving portion 62 which abuts the step portion 81. A sliding contact surface 63 is formed on the receiving portion 62. The small-diameter piston 70 is in sliding contact with the sliding contact surface 63.

The sliding contact surface 63 of the receiving portion 62 is in sliding contact with the base 73 of the piston shoe 72. The piston shoe 72 is held in a state sandwiched between the receiving portion 62 of the piston receiving member 60 and the receiving portion 71*a* of the piston body 71. Therefore, in the present embodiment, in a case where the tilt angle is in the minimum state, when the control pressure Pc is lowered and the small-diameter piston 70 is pushed toward the swash plate 8 by the discharge pressure P1 of the piston pump 100, the piston shoe 72 provided at the distal end of the small-diameter piston 70 presses the swash plate body 91 via the piston receiving member 60. Thus, the tilt angle of the swash plate 8 increases.

Since the stopper 40 is smaller in size and simpler in shape than the cover 3*b*, it is possible to easily perform surface treatment such as heat treatment. Therefore, it is possible to easily improve the hardness of the sliding surface 43 on which the outer peripheral surface of the small-diameter piston 70 slides. Thus, backlash and/or prizing between the small-diameter piston 70 and the sliding surface 43 are prevented over a long period, and thereby, it is possible to maintain good sliding property. As a result, it is possible to prevent the control of the swash plate 8 from becoming unstable due to the backlash or the like, and to maintain good pump performance for a long period.

Furthermore, in the present embodiment, by improving the hardness of the sliding surface 43, it can be set shorter axial length of the piston body 71. Thus, it is possible to reduce the frictional resistance between the sliding surface 43 and the piston body 71. As a result, the hysteresis of the tilt angle of the swash plate 8 between increasing the tilt angle and decreasing the tilt angle, which is set in accordance with the control pressure Pc, can be reduced.

Further, since the piston receiving member 60 is smaller in size and simpler in shape than the swash plate 8, it is possible to easily perform surface treatment such as heat treatment. Therefore, it is possible to easily improve the hardness of the sliding contact surface 63 which the piston shoe 72 of the small-diameter piston 70 is in sliding contact with. Thus, it is possible to prevent wear of the sliding contact surface 63.

When the swash plate 8 is worn, the position of the force transmitted from each of the small-diameter piston 70, the large-diameter piston 23, and the feedback pin 55 may change, and thereby, the performance of the piston pump 100 may change. In the present embodiment, as described above, since the small-diameter piston 70 is in sliding contact with the piston receiving member 60 attached to the swash plate 8, the wear of the swash plate 8 can be prevented. As a result, the performance of the piston pump 100 can be well maintained for a long period.

As shown in FIGS. 1 and 2, a front-side first recess 83 and a front-side second recess 84 as recesses are formed on the front surface of the swash plate 8. The cylindrical or spherical first support member 86 is accommodated in the front-side first recess 83. The cylindrical or spherical second support member 87 is accommodated in the front-side second recess 84.

The first support member 86 is held in a state sandwiched between the front-side first recess 83 and the large-diameter piston 23. That is, the large-diameter piston 23 transmits a force to the swash plate 8 via the first support member 86. The second support member 87 is held in a state sandwiched between the front-side second recess 84 and the feedback pin 55. That is, the feedback pin 55 transmits a force to the swash plate 8 via the second support member 87.

Since the first support member 86 is smaller in size and simpler in shape than the swash plate 8, surface treatment such as heat treatment can be easily performed. Therefore, it is possible to easily improve the hardness of a sliding contact surface 86*a* which the large-diameter piston 23 is in sliding contact with. Similarly, since the second support member 87 is smaller in size and simpler in shape than the swash plate 8, surface treatment such as heat treatment can be easily performed. Therefore, it is possible to easily improve the hardness of a sliding contact surface 87*a* which the feedback pin 55 is in sliding contact with.

Since the large-diameter piston 23 is in sliding contact with the first support member 86 provided on the swash plate 8, wear of the swash plate 8 can be prevented. Further, since the feedback pin 55 is in sliding contact with the second support member 87 provided on the swash plate 8, wear of the swash plate 8 can be prevented. As a result, the performance of the piston pump 100 can be well maintained for a long period.

The large-diameter piston 23 biases the swash plate 8 against the force transmitted from the small-diameter piston 70 to the swash plate 8 and the force transmitted from the feedback pin 55 to the swash plate 8. Therefore, the force acting on the front-side first recess 83 of the swash plate 8 from the first support member 86 is larger than the force acting on the front-side second recess 84 of the swash plate 8 from the second support member 87. In the present embodiment, as shown in FIGS. 3A and 3B, a curved surface 83*a* contacting the outer peripheral surface of the first support member 86 is formed at the bottom of the front-side first recess 83. Therefore, as compared with a case where the first support member 86 and the bottom of the front-side first recess 83 are point contact or line contact with each other, the load applied from the first support member 86 to the bottom of the front-side first recess 83 can be dispersed, and thereby, wear of the front-side first recess 83 can be effectively prevented.

The bottom of the front-side first recess 83 and the bottom of the back-side recess 82 are communicated through a communication passage 89. Therefore, when the press-fit portion 61 of the piston receiving member 60 is press-fitted to the back-side recess 82, a gas between the back-side recess 82 and the press-fit portion 61 is discharged to the front-side first recess 83 through the communication passage 89. Therefore, the piston receiving member 60 can be appropriately and easily attached to the swash plate 8.

Further, in the present embodiment, as shown in FIG. 1, each member is disposed so that a contact portion C1 between the small-diameter piston 70 and the swash plate 8, a contact portion C2 between the large-diameter piston 23 and the swash plate 8, and a contact portion C3 between the feedback pin 55 and the swash plate 8 are positioned on the same plane. The effect of this configuration will be described in comparison with the comparative example.

In the comparative example of the present embodiment, the contact portion C2 is disposed on a virtual plane which is perpendicular to the swing center axis O2 of the swash plate 8 and includes the rotation center axis O1 of the cylinder block 2. Further, in the comparative example of the present embodiment, the contact portion C1 is disposed at a position separated from the virtual plane by a predetermined distance on one side. The contact portion C3 is disposed at a position separated from the virtual plane by a predetermined distance on the other side (the side opposite to the contact portion C1). For example, the contact portion C1 and the contact portion C3 are disposed so as to be plane symmetric with respect to the virtual plane. In such a configuration, there is a case where the swash plate 8 is inclined in a direction different from the swing direction. For example, the swash plate 8 may be inclined around an axis orthogonal to the rotation center axis O1 and the swing center axis O2.

In contrast, in the present embodiment, since the contact portion C1, the contact portion C2, and the contact portion C3 are disposed on the same plane, it is possible to prevent the swash plate 8 from inclining in a direction different from the swing direction. As a result, the hysteresis of the tilt angle of the swash plate 8 between increasing the tilt angle and decreasing the tilt angle, which is set in accordance with the control pressure Pc, can be reduced. Further, in the present embodiment, since the small-diameter piston 70 and the large-diameter piston 23 sandwich the swash plate 8 on the same straight line, vibration of the swash plate 8 can be suppressed as compared with the comparative example. Thus, in the present embodiment, since the control hysteresis is reduced and the vibration of the swash plate 8 can be suppressed, the tilt control of the swash plate 8 can be performed more stably. As a result, the discharge rate of the piston pump 100 is more stable.

Furthermore, in the present embodiment, the small-diameter piston 70 presses the back surface of the swash plate 8 by the pressure of the pressure chamber 29. Therefore, since the load applied to the tilt bearing 11 can be reduced as compared with a case where the small-diameter piston 70 presses the front surface of the swash plate 8, damage to the tilt bearing 11 can be effectively prevented.

According to the above-described embodiment, the following operational effects can be achieved.

In the present embodiment, a small-diameter piston 70 as the tilt control piston is slidably supported by the stopper 40 mounted to the cover 3*b* constituting the case 3. Since the stopper 40 is smaller in size than the cover 3*b*, it is possible to easily perform surface treatment such as heat treatment. Therefore, it is possible to easily improve the wear resistance of the sliding surface 43 which the small-diameter piston 70 slides. Thus, since it is possible to maintain good slidability of the small-diameter piston 70 for a long period, it is possible to maintain good performance of the piston pump 100 for a long period.

The following modifications are also within the scope of the present invention, and it is also possible to combine the configurations shown in the modifications with the configurations described in the above embodiments, or to combine the configurations described in the following different modifications.

<Modification 1> In the above embodiment, an example in which the piston receiving member 60 is provided between the swash plate body 91 and the small-diameter piston 70 has been described, but the present invention is not limited thereto. The piston receiving member 60 may be omitted. In this case, the swash plate body 91 abuts the stopper 40 directly, and thereby, the minimum tilt angle is defined. Further, the swash plate body 91 is directly pressed by the small-diameter piston 70 in a direction in which the tilt angle increases.

<Modification 2> In the above embodiment, an example in which the contact portion C1, the contact portion C2, and the contact portion C3 are located on the same plane has been described, but the present invention is not limited thereto. For example, the contact portion C2 may be disposed on an virtual plane orthogonal to the rotation center axis O1 and the swing center axis O2, and the contact portion C1 and the contact portion C3 may be disposed so as to be plane symmetric with respect to the virtual plane.

<Modification 3> In the above embodiment, an example in which the small-diameter piston 70 for biasing the swash plate 8 by the discharge pressure P1 of the piston pump 100 is slidably supported by the stopper 40 has been described, but the present invention is not limited thereto. The tilt control piston for biasing the swash plate 8 by the control pressure Pc may be slidably supported by the stopper 40.

The configuration, operation, and effect of the embodiment of the present invention configured as described above will be collectively described.

The hydraulic rotating machine (the piston pump 100 and piston motor) includes the case 3, the cylinder block 2 housed in the case 3 and having a plurality of cylinders 2*b*, the piston 5 reciprocatively inserted into the cylinder 2*b*, the swash plate 8 configured to reciprocate the piston 5 as the cylinder block 2 rotates, the tilt control piston (small-diameter piston 70) configured to biase the swash plate 8 and control the tilt angle of the swash plate 8, and the stopper 40 which is mounted to the case 3 and configured to define the minimum tilt angle of the swash plate 8. The stopper 40 has a sliding surface 43 for slidably supporting the tilt control piston (small-diameter piston 70).

In this configuration, the tilt control piston (small-diameter piston 70) is slidably supported by the stopper 40 mounted to the case 3. Since the stopper 40 is smaller in size than the case 3, it is possible to easily perform surface treatment such as heat treatment. Therefore, it is possible to easily improve the wear resistance of the sliding surface 43 which the tilt control piston (small-diameter piston 70) slides.

In the hydraulic rotating machine (the piston pump 100 and the piston motor), the swash plate 8 includes the swash plate body 91 and the piston receiving member 60 attached to the swash plate body 91 and having the sliding contact surface 63 which the tilt control piston (the small-diameter piston 70) is in sliding contact with.

In this configuration, the tilt control piston (the small-diameter piston 70) is in sliding contact with the piston receiving member 60 attached to the swash plate body 91. Since the piston receiving member 60 is smaller in size than the swash plate body 91, it is possible to easily perform surface treatment such as heat treatment. Therefore, it is possible to easily improve the wear resistance of the sliding contact surface 63 which the tilt control piston (small-diameter piston 70) is in sliding contact with.

Embodiments of this invention were described above, but the above embodiments are merely examples of applications of this invention, and the technical scope of this invention is not limited to the specific constitutions of the above embodiments.

This application claims priority based on Japanese Patent Application No. 2019-010394 filed with the Japan Patent Office on Jan. 24, 2019, the entire contents of which are incorporated into this specification.

The invention claimed is:

1. A hydraulic rotating machine, comprising:

a case:

a cylinder block housed in the case and having a plurality of cylinders;

a piston reciprocatively inserted into each of the cylinders;

a swash plate configured to reciprocate the pistons as the cylinder block rotates;

a tilt control piston configured to bias the swash plate and control a tilt angle of the swash plate; and a stopper mounted to a mounting hole formed in the case, the stopper and the cylinder block being respectively located on opposite sides of the swash plate, the stopper being configured to define a minimum tilt angle of the swash plate, wherein the stopper has a sliding surface provided at an inner circumference thereof for slidably supporting the tilt control piston and an abutting portion which abuts the swash plate.

2. The hydraulic rotating machine according to claim 1, wherein:

the swash plate includes:

a swash plate body; and a piston receiving member attached to the swash plate body and having a sliding contact surface which the tilt control piston is in sliding contact with.

* * * * *